US011910986B2

(12) United States Patent
Protz et al.

(10) Patent No.: US 11,910,986 B2
(45) Date of Patent: Feb. 27, 2024

(54) FLOOR CLEANING MACHINE

(71) Applicant: Hako GmbH, Bad Oldesloe (DE)

(72) Inventors: Carsten Protz, Altenkrempe (DE); Bertram Ulrich, Lübeck (DE)

(73) Assignee: Hako GmbH, Bad Oldesole (DE)

( * ) Notice: Subject to any disclaimer, the term of this patent is extended or adjusted under 35 U.S.C. 154(b) by 0 days.

(21) Appl. No.: 17/851,732

(22) Filed: Jun. 28, 2022

(65) Prior Publication Data

US 2022/0408990 A1 Dec. 29, 2022

(30) Foreign Application Priority Data

Jun. 29, 2021 (DE) ..... 102021116686.1

(51) Int. Cl.
*A47L 7/00* (2006.01)
*A47L 5/36* (2006.01)

(52) U.S. Cl.
CPC ..... *A47L 7/0004* (2013.01); *A47L 5/365* (2013.01)

(58) Field of Classification Search
CPC ..... A47L 7/0004; A47L 5/365; A47L 5/30; A47L 9/0009; A47L 11/307; A47L 11/4016; A47L 11/4036; A47L 11/4075; A47L 11/16; A47L 7/02; A47L 11/20; A47L 11/305; A47L 11/40; A47L 11/4002; A47L 11/4027; B24B 7/18; B24B 55/12
See application file for complete search history.

(56) References Cited

U.S. PATENT DOCUMENTS 3,101,505 A 8/1963 Belicka et al.

FOREIGN PATENT DOCUMENTS

| | | | |
|---|---|---|---|
| EP | 1018314 | A1 | 7/2000 |
| EP | 2250957 | A2 | 11/2010 |
| WO | WO2016/022270 | A1 | 2/2016 |
| WO | WO2020/234904 | A1 | 11/2020 |

OTHER PUBLICATIONS

European Search Report dated Nov. 28, 2022 for corresponding European Application No. 22181921.2 filed Jun. 29, 2022.
European Search Report dated Dec. 5, 2022 for corresponding European Application No. 22181912.1 filed Jun. 29, 2022.

*Primary Examiner* — David Redding
(74) *Attorney, Agent, or Firm* — Reising Ethington P.C.

(57) ABSTRACT

A floor cleaning machine having a base, a suction foot, a dirty water tank in fluid communication with the suction foot, a suction turbine, and a separation container. The suction turbine is attached to the base and generates a suction air flow from the suction foot into the dirty water tank. The suction turbine has a housing with an inlet opening and an outlet opening through which air flows. The separation container adjoins the suction turbine housing and has an interior, which that communicates with the inlet opening and a bottom wall section that faces the interior. The bottom wall section is disposed vertically lower than the inlet opening. A drainage opening leads out of the bottom wall section into the environment and is provided with a valve that is closed during operation of the suction turbine is in operation and open when the suction turbine is not operated.

12 Claims, 7 Drawing Sheets

FLOOR CLEANING MACHINE

CROSS-REFERENCE TO RELATED APPLICATIONS

This application claims the benefit of German Patent Application No. 10 2021 116 686.1, the disclosure of which is incorporated by reference as if fully set forth in detail herein.

FIELD

The present disclosure relates to a floor cleaning machine, in particular a scrubber dryer, having a cleaning element arrangement for engagement with a floor surface to be cleaned.

BACKGROUND

This section provides background information related to the present disclosure which is not necessarily prior art.

Such floor cleaning machines comprise a base and a cleaning element arrangement, which is held and driven on an underside of the base and have driven cleaning elements which can engage with a floor surface to be cleaned. In this case, the brushes are used, in particular, for scrubbing a floor surface. Furthermore, the floor cleaning machine comprises an operating bar, which is attached to the base, preferably movably, in particular pivotably, via a joint, for guiding and actuating the floor cleaning machine. In this case, the machine can be guided and actuated directly by a user.

In addition, the floor cleaning machines have a suction foot, attached to the base or to the operating bar, for sucking up cleaning liquid from the floor surface, a dirty water tank, attached to the base or to the operating bar, for receiving cleaning liquid taken up by the suction foot, and a suction turbine, which has a suction turbine housing, which has an inlet opening and an outlet opening. In this case, the suction turbine is configured to generate a suction air flow from the suction foot into the dirty water tank, wherein the suction turbine is constructed in such a way that the suction air flow runs through the inlet opening towards the outlet opening.

EP 2 962 614 B1, for example, discloses a floor cleaning machine having a base and an operating bar which extends away therefrom and is connected to the base via a joint. Furthermore, two cleaning elements driven to rotate in opposite directions are provided on a base, the axes of rotation of said cleaning elements being inclined relative to one another with respect to a vertical. This ensures that when the two cleaning elements rotate, a thrust is exerted on the base of the floor cleaning machine. However, because the cleaning elements are inclined relative to one another, the cleaning effect is not uniform in the region of the rotationally driven cleaning elements. On the contrary, the cleaning elements rest less strongly against the floor surface to be cleaned at the outer edge, with the result that the cleaning effect there is less. Moreover, the thrust produced continuously by the rotationally driven cleaning elements is frequently disadvantageous during operation. This is because a user must apply a considerable force to move the floor cleaning machine in other directions that deviate from the direction of thrust. In addition, the suction turbine in the floor cleaning machine known from this prior art is provided separately from the base and is carried as a separate component by the user, which is comparatively uncomfortable. As a departure from this prior art, there is furthermore a known practice of attaching the suction turbine to the operating bar, this being associated with the disadvantage that the latter has a comparatively high weight, with the result that it is difficult to move by a user and, when the operating bar is inclined, produces large torques which force the operating bar into more inclined positions.

It is therefore desirable for the suction turbine to be attached to the base of the floor cleaning machine. However, this is associated with the disadvantage of the following problem. If the suction turbine is attached at a comparatively low point of the floor cleaning machine, when viewed in the vertical direction, there is the risk that water contained in the suction air flow will collect in the region of the suction air turbine and a liquid level in this region will rise to such an extent that a turbine wheel of the suction turbine will move through this liquid. Moreover, owing to the low position of the suction turbine, liquid laden with dirt can get into the latter and, in particular, into its drive motor. As a result, the suction turbine may be damaged owing to corrosion. This applies, in particular, to the turbine wheel, the bearings and the drive motor.

It is therefore one object of the present disclosure to provide a floor cleaning machine in which the operating bar has a comparatively low dead weight and the suction turbine is mounted in such a way that the risk of it being subjected to liquid laden with dirt is greatly reduced.

SUMMARY

This section provides a general summary of the disclosure, and is not a comprehensive disclosure of its full scope or all of its features.

According to the disclosure, this object can be achieved by a floor cleaning machine having a base, a cleaning element arrangement, held and driven on an underside of the base, for engagement with a floor surface, in which the cleaning element arrangement has at least one driven cleaning element, to which engagement elements for engagement with a floor surface to be cleaned are attached, in which sections of the engagement elements which are provided for engagement with the floor surface extend in an engagement element plane. Furthermore, the floor cleaning machine according to the disclosure can have an operating bar, which is attached to the base, for example pivotably via a joint, and which is used to guide and actuate the floor cleaning machine. In addition, a suction foot for sucking up cleaning liquid from the floor surface is provided on the base or on the operating bar, and a dirty water tank for receiving cleaning liquid taken up by the suction foot is furthermore attached to the base or the operating bar.

Furthermore, according to the disclosure, a suction turbine is attached to the base, which suction turbine has a suction turbine housing, which has an inlet opening and an outlet opening, in which the suction turbine is configured to generate a suction air flow from the suction foot into the dirty water tank, in which the suction turbine is constructed in such a way that the suction air flow runs through the inlet opening towards the outlet opening when the suction turbine is in operation.

According to the disclosure, the suction turbine is provided with a separation container, which adjoins the suction turbine housing, in which the interior thereof communicates with the inlet opening of the suction turbine housing, and which has an inlet communicating with the interior and a bottom wall section facing the interior. When viewed along a vertical axis running perpendicularly to the engagement element plane, the bottom wall section is arranged closer to the engagement element plane than the inlet opening. Furthermore, a drainage opening leads out of the bottom wall section into the environment, which opening is provided with a valve, which is configured in such a way that it is closed when the suction turbine is in operation and open when the suction turbine is out of operation.

Accordingly, a floor cleaning machine according to the disclosure can have a base, on which a driven cleaning element arrangement provided with cleaning elements is provided, wherein the sections of the engagement elements which engage with the floor surface to be cleaned are arranged in an engagement element plane. Moreover, a suction turbine is attached to the base, which turbine generates a suction air flow from the suction foot into a dirty water container when it is in operation. For this purpose, the suction turbine has a suction turbine housing, which is provided with an inlet opening and an outlet opening, wherein the suction air flow leads from the inlet opening to the outlet opening during the operation of the suction turbine. In addition, according to the disclosure, a separation container is provided, which has a bottom wall section, which, when viewed in the direction of a vertical axis running perpendicularly to the engagement element plane, is arranged closer to the engagement element plane than the inlet opening. Moreover, the separation container is provided with an inlet, from which the suction air flow generated by the suction turbine flows to the inlet opening when the suction turbine is in operation. Finally, a drainage opening is provided in the bottom wall section, which opening is provided with a valve, which is configured in such a way that it closes when the suction turbine is in operation and opens when the suction turbine is out of operation. The position of the valve thus depends on whether the suction turbine is in operation or not.

With the construction according to the disclosure, it is ensured that the suction air flow flows through the separation container towards the inlet opening in the suction turbine housing. Owing to the fact that the separation container and, in particular, its bottom wall section are arranged closer to the engagement element plane than the inlet opening, cleaning liquid collects in the separation container and does not get into the suction turbine since the separation container is lower than the suction turbine. When the suction turbine is switched off, this causes the valve, which is configured in such a way that it is closed when the suction turbine is in operation and open when the suction turbine is out of operation, to open. Cleaning liquid which has collected in the separation container then flows off through the opening. If the machine is put back into operation and the suction turbine is switched on, the valve in the drainage opening closes and the suction air flow can build up.

In this way, it is ensured in the case of the floor cleaning machine according to the disclosure that, despite the arrangement of the suction turbine on the base and thus at a comparatively low position, the latter cannot be damaged on account of cleaning liquid which collects on the suction side ahead of the turbine. On the contrary, water collecting there is regularly drained off via the drainage opening, which is arranged at a position below the suction turbine, when the suction turbine is switched off.

In one embodiment, it is possible for the valve to be embodied as a solenoid valve that is electrically closed when the suction turbine is supplied with electrical power and opens when the suction turbine is no longer supplied with power.

In another embodiment, the valve can be configured in such a way that it closes when the pressure in the separation container is below the ambient pressure and opens when the pressure in the separation container is greater than or equal to the ambient pressure. When the suction turbine is switched off, the pressure in the interior of the receiving container and the ambient pressure equalize, which has the effect that in this embodiment the valve in the drainage opening opens, ensuring that cleaning liquid which has collected in the separation container flows off. If the machine is put back into operation and the suction turbine is switched on, the pressure in the separation container drops below the ambient pressure, with the result that the valve in the drainage opening closes again and the suction air flow can build up. In this embodiment, therefore, no further actuator or the like is required in order to open and close the valve; on the contrary, the pressure generated by the suction turbine is sufficient on its own.

Furthermore, the valve can be configured in such a way that the valve has a flexible tab, which is attached to the outside of the separation container, opposite the drainage opening, wherein the flexible tab is prestressed in such a way that a section thereof is spaced apart from the drainage opening and exposes the latter when the pressure in the separation container is greater than or equal to the ambient pressure, and that the section closes the drainage opening when the pressure in the separation container is below the ambient pressure. In this way, it is possible in a simple way to configure a valve which opens and closes solely on the basis of the pressure in the separation container.

The suction turbine may have a turbine wheel, which is driven in rotation about a turbine wheel axis, wherein the turbine wheel axis coincides with the vertical axis and wherein the inlet opening is closer to the engagement element plane than the turbine wheel when viewed in the direction of the vertical axis. Such an embodiment has proven to be particularly efficient for generating a suction air flow.

The suction turbine may have a turbine motor with a rotationally driven motor shaft, wherein the motor shaft extends along the turbine axis and is connected to the turbine wheel. Such a construction is particularly space-saving since the turbine wheel and the motor shaft are arranged coaxially.

The turbine wheel can be designed as a radial fan wheel which is configured in such a way that, during rotation, it generates an air flow from an inlet lying on the turbine wheel axis radially outwards, wherein the suction turbine housing surrounds the turbine wheel, and the inlet opening is arranged on the turbine wheel axis and lies opposite the inlet. Since, in the case of a turbine wheel designed in this way, the suction air flow emerges laterally, when viewed in the axial direction of the turbine axis, it is possible in this way to create a turbine arrangement whose axial length is comparatively small. Thus, on this basis, the turbine arrangement has only a low height, which is advantageous for the use of the floor cleaning machine.

The separation container can have a receiving opening, which is situated opposite the bottom wall section and the edge of which rests sealingly against the suction turbine housing, wherein the inlet opening is arranged in that region of the suction turbine housing which is enclosed by the edge, and wherein the separation container is detachably connected to the suction turbine housing. Owing to the fact that the separation container is detachably attached to the suction turbine housing, the interior of the separation container can be easily cleaned, this being required at regular intervals owing to the dirt which is contained in the cleaning liquid.

The bottom wall section may have an inlet opening section which is situated opposite the inlet opening, wherein the bottom wall section has a drainage section, from which the drainage opening starts, and wherein, when viewed along the vertical axis, the drainage section is closer to the engagement element plane than the inlet opening section. In such an embodiment, it is ensured that no water can initially collect directly below the inlet opening, but instead this flows off in the direction of the drainage section or collects there. In order to reliably prevent the accumulation of cleaning liquid directly below the inlet opening, it is particularly preferred if the inlet opening section is the part of the bottom wall section which is closest to the inlet opening when viewed along the vertical axis.

In order to prevent water or cleaning liquid that collects in the separation container from moving into the inlet, it is further preferred if, when viewed along the vertical axis, the inlet opens into the interior at a position which is further away from the engagement element plane than the bottom wall section. This ensures that cleaning liquid is already drained from the bottom wall section before it reaches a level at which it can flow into the inlet. As a further preference, the inlet is provided in a wall section of the separation container which, when viewed from the interior, faces away from the engagement element plane and which preferably runs parallel to the engagement element plane.

The suction foot can be connected to the dirty water tank by a first line, wherein the dirty water tank is connected to the inlet of the separation container by a second line, and wherein, when the suction turbine is in operation, the suction air flow runs from the suction foot, through the dirty water tank and through the separation container, to the inlet opening. In this embodiment, the suction turbine is arranged downstream of the dirty water tank, and therefore, for this reason alone, the amount of cleaning liquid to which the suction turbine is subjected is minimal.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
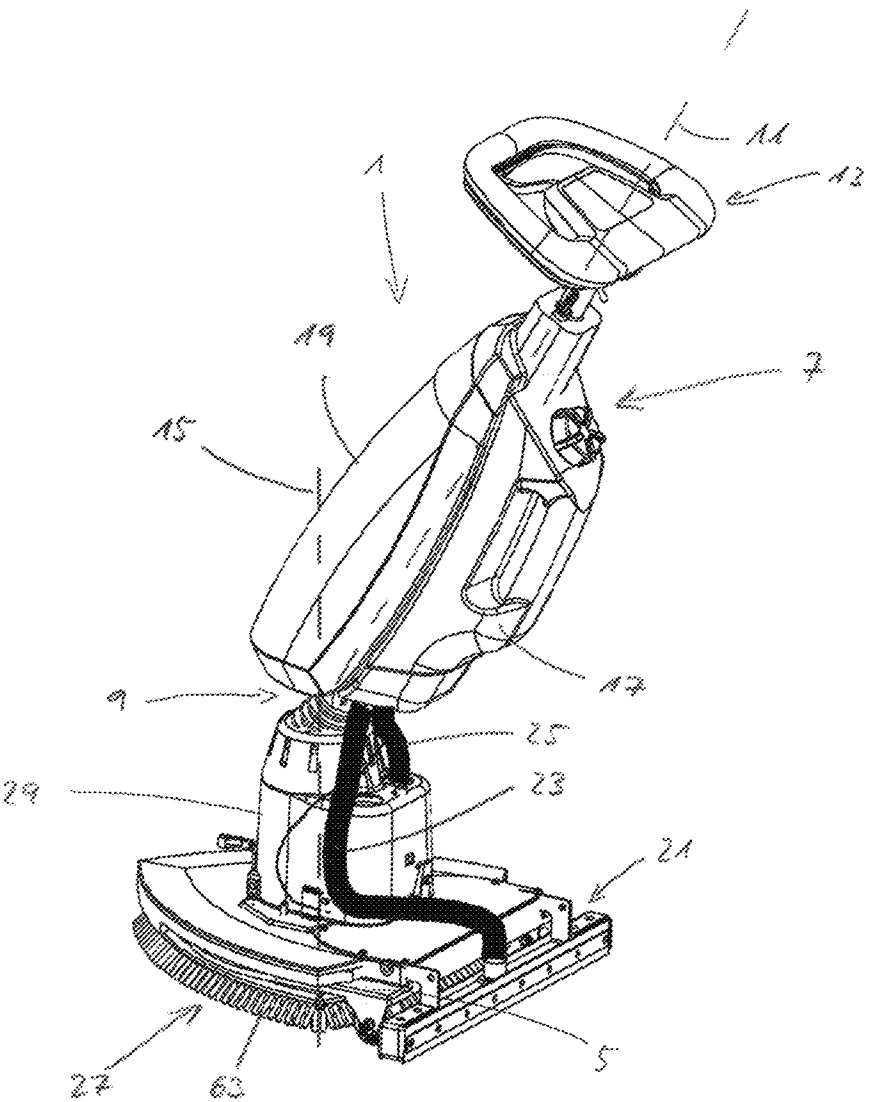
FIG. 1 is a perspective view of a floor cleaning machine according to the present disclosure.

FIG. 1 illustrates an exemplary embodiment of a floor cleaning machine 1 according to the present disclosure, which is designed here as a hand-guided scrubber dryer and which is provided with a cleaning element arrangement, by means of which cleaning liquid can be applied to the floor surface 3 (see FIG. 3) and which has cleaning elements for engagement with the floor surface 3 to be cleaned, and with a suction foot, by means of which scrubbing residues, including the cleaning liquid, can subsequently be sucked off. The floor cleaning machine 1 described here has an operating bar 7, which is attached to a base 5 of the floor cleaning machine 1 and will be described in detail below, wherein the operating bar 7 is pivotably attached to a base 5.

As already mentioned, the exemplary embodiment of a floor cleaning machine 1 according to the disclosure described here comprises a base 5, to which an operating bar 7 is pivotably attached via a joint 9. The operating bar 7 extends from the joint 9, via which it is pivotably connected to the base 5, along a longitudinal axis 11 to an actuating end 13. In this case, the joint 9 is configured in such a way that, when the operating bar 7 is pivoted about the longitudinal axis 11, a torque is exerted on the base 5, with the result that the latter is pivoted about a vertical axis 15 with respect to the floor surface 3, the vertical axis 15 running perpendicularly to the floor surface 3. On account of its construction, the joint 9 therefore makes it possible for a user who grips the operating bar 7 at its actuating end 13 to be able to steer the base 5.

A cleaning liquid container 17 and a dirty water tank 19 are releasably attached to the operating bar 7 and are connected, in a manner still to be described, to the base 5 and to a suction foot 21, which is held pivotably on the base 5, via a first line 23 and a second line 25. In this case, the suction foot 21 can be pivoted between the position shown in the figures, in which it is situated opposite the floor surface 3 to be cleaned, and a raised position, in which it is spaced apart from the floor surface 3.

Finally, a cleaning element arrangement 27, which is configured to engage with the floor surface 3 to be cleaned, is provided on the underside of the base 5, which faces the floor surface 3 to be cleaned, wherein the cleaning element arrangement 27 is driven by a drive motor 31, which is arranged in a housing 29 on the base. The drive motor 31 can be, for example, an electric motor which is supplied by a battery unit, not illustrated in detail in the figures, which is attached to the base 5 or the operating bar 7. However, it is also conceivable in principle for the drive motor 31 to be driven by compressed air, and therefore the disclosure is not restricted to the use of electric motors.

Figure 2:
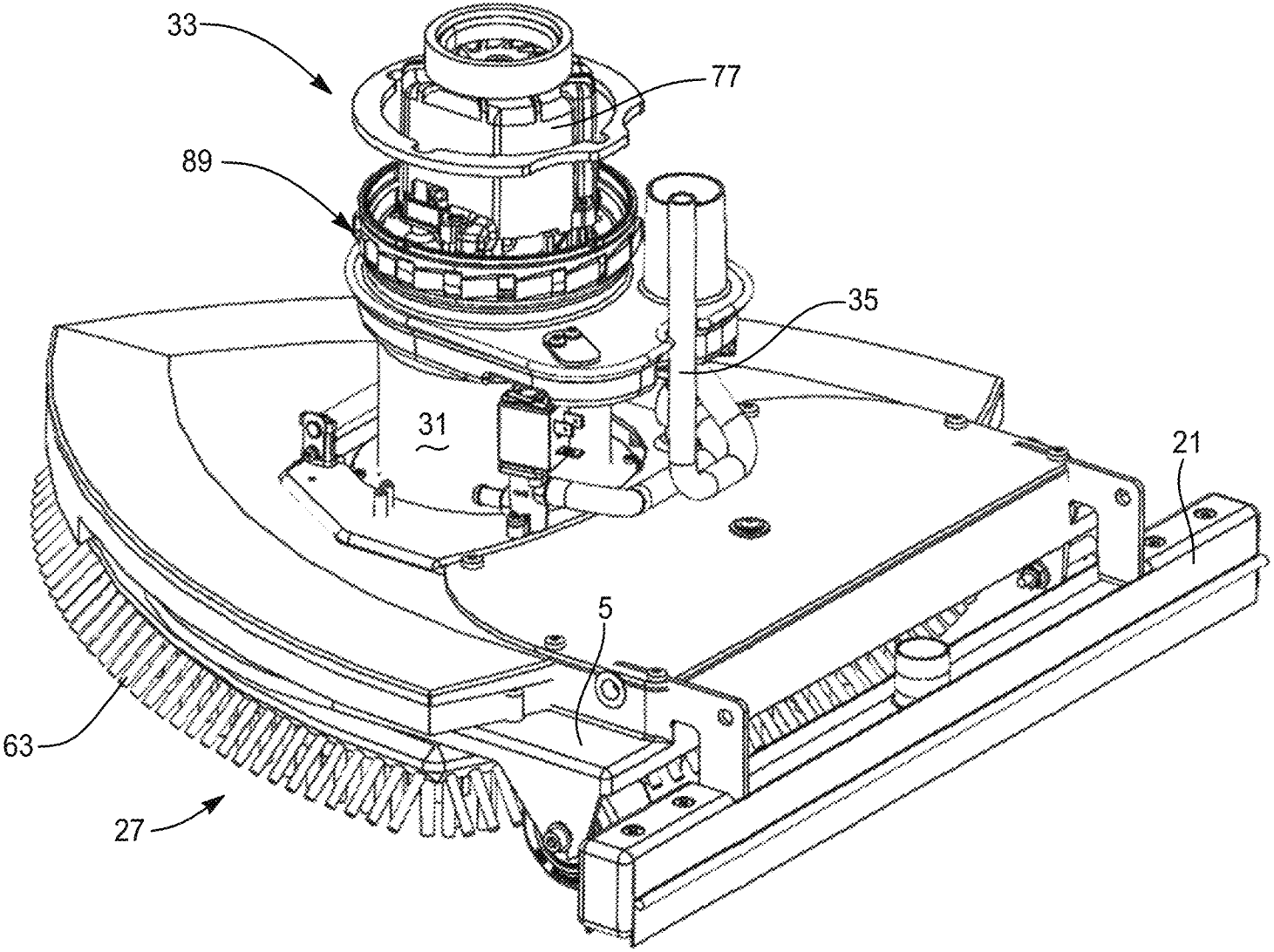
FIG. 2 is a perspective view of the base of the floor cleaning machine from FIG. 1 with the housing partially removed.

Also arranged in the housing 29 of the base 5 is a suction turbine 33, the suction side of which is connected via the second line 25 to the upper end of the dirty water tank 19. The dirty water tank 19, in turn, is connected to the suction foot 21 via the first line 23. The suction turbine 33 forms a suction device, with the aid of which a suction air flow from the suction foot 21 into the dirty water tank 19 is generated, thus enabling previously applied cleaning liquid to be sucked off from the floor surface 3 to be cleaned. As can also be seen from FIGS. 2 and 3, further lines 35 are provided in the base 5, via which cleaning liquid can be applied from the cleaning liquid container 17, through the base 5, into the region of the cleaning element arrangement 27 and, in the process, onto the floor surface 3 to be cleaned.

Figure 3:
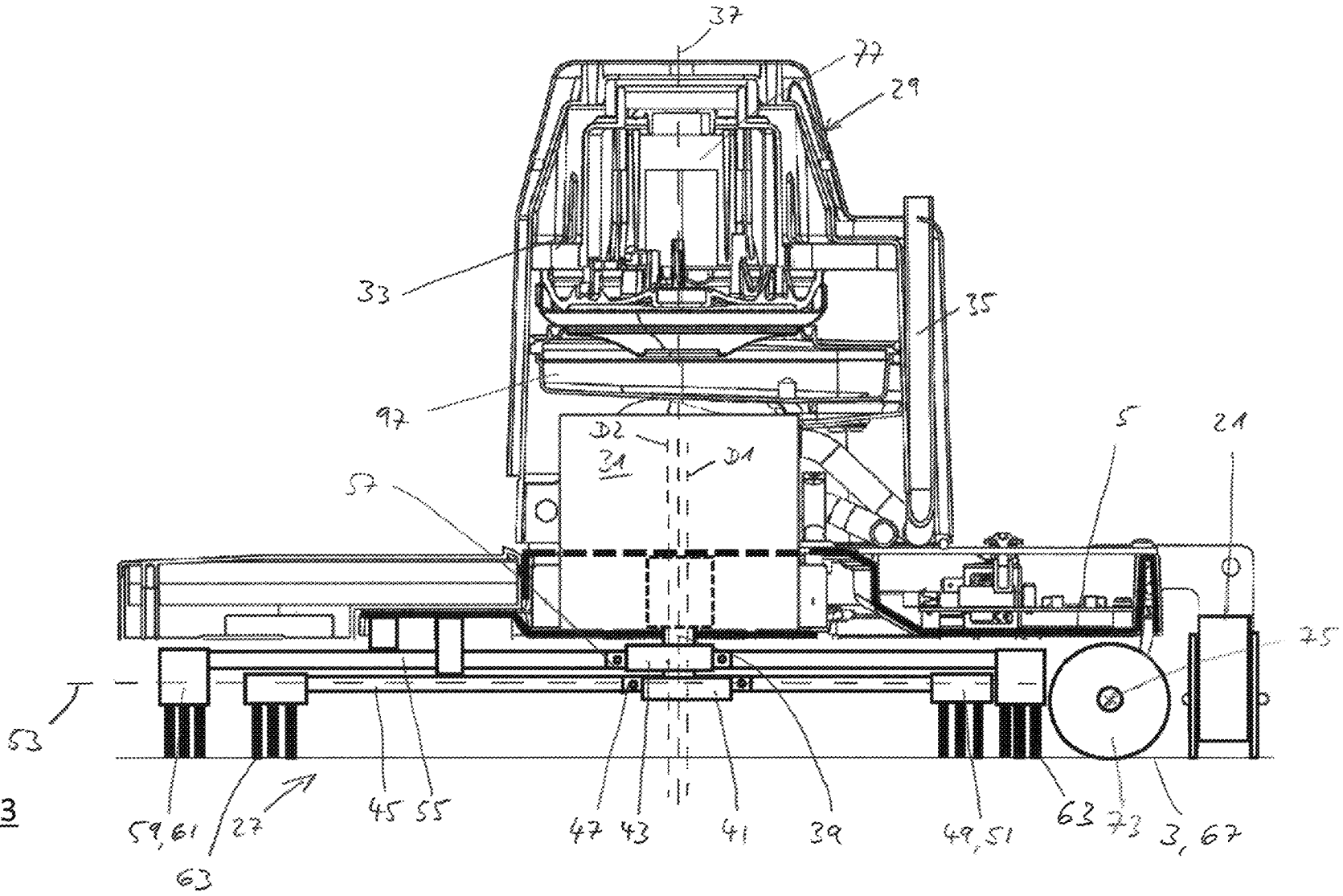
FIG. 3 is a cross-sectional view of the base of the floor cleaning machine from FIG. 1.

As can be seen, in particular, from FIG. 3, the drive motor 31 has an output shaft 39, which extends along an output axis 37 and is driven in rotation by the drive motor 31. Mounted one behind the other on the output shaft 39 when viewed in the axial direction of the output axis 37, for conjoint rotation therewith, are a first eccentric disc 41 and a second eccentric disc 43. A first receiving element 45 is secured in a rotatable manner via a first bearing 47 on the outer circumference of the first eccentric disc 41, wherein the first receiving element 45 is connected in a fixed manner to the inner cleaning body 49 of an inner cleaning element 51. Here, the first receiving element 45 is rotatable with respect to the first eccentric disc 41 about a first axis of rotation D1, which runs parallel to the output axis 37. In this case, the inner cleaning body 49 of the inner cleaning element 51 has a first receiving opening, in which the first receiving element 45 is received. In addition, the inner cleaning body 49 extends in a cleaning body plane 53 which, during the operation of the floor cleaning machine 1, if the latter is arranged on a floor surface 3 to be cleaned, extends substantially parallel to the plane of the floor surface 3 to be cleaned.

In a similar way, a second receiving element 55 is attached in a rotatable manner via a second bearing 57 to the outer circumference of the second eccentric disc 43, wherein the second receiving element 55 is connected in a fixed manner to an outer cleaning body 59 of an outer cleaning element 61. Here, the second receiving element 55 is rotatable with respect to the second eccentric disc 43 about a second axis of rotation D2, which runs parallel to the output axis 37 and the first axis of rotation D1. In this case, the outer cleaning body 59 has a second receiving opening, in which, on the one hand, the second receiving element 55 and, on the other hand, the inner cleaning body 49 of the inner cleaning element 51 are received. Therefore, the outer cleaning body 59 surrounds the inner cleaning body 49, and the outer cleaning element 61 is arranged externally around the inner cleaning element 51. Moreover, the outer cleaning body 59, and thus the outer cleaning element 61, also extends in the cleaning body plane 53.

Both the inner cleaning body 49 and the outer cleaning body 59 are arranged in the cleaning body plane 53, i.e. at least parts both of the inner cleaning body 49 and of the outer cleaning body 59 intersect the cleaning body plane 53 when viewed in cross section. Furthermore, it can be seen from FIG. 3 that the inner cleaning element 51 and the outer cleaning element 61 have engagement elements 63, which are secured on the respective inner and outer cleaning bodies 49, 59, and point towards the side of the cleaning body plane 53 which faces the floor surface 3 to be cleaned. In the exemplary embodiment described here, the engagement elements 63 are designed as bristles and are generally intended to engage with the floor surface 3 to be cleaned by means of their end sections 65. Here, the end sections 65 are arranged in an engagement element plane 67.

In the exemplary embodiment described here, the engagement elements 63 are designed as bristles. However, it is also conceivable for other forms of engagement elements, such as pads or the like, to be used.

In the exemplary embodiment described here, the first and second eccentric discs 41, 43 are furthermore arranged in such a way that the first and the second axis of rotation D1, D2 and the output axis 37 run in a common plane. This is associated with the fact that the first and second eccentric discs 41, 43 are secured on the output shaft 39 in a manner offset by 180° with respect to one another.

Figure 4:
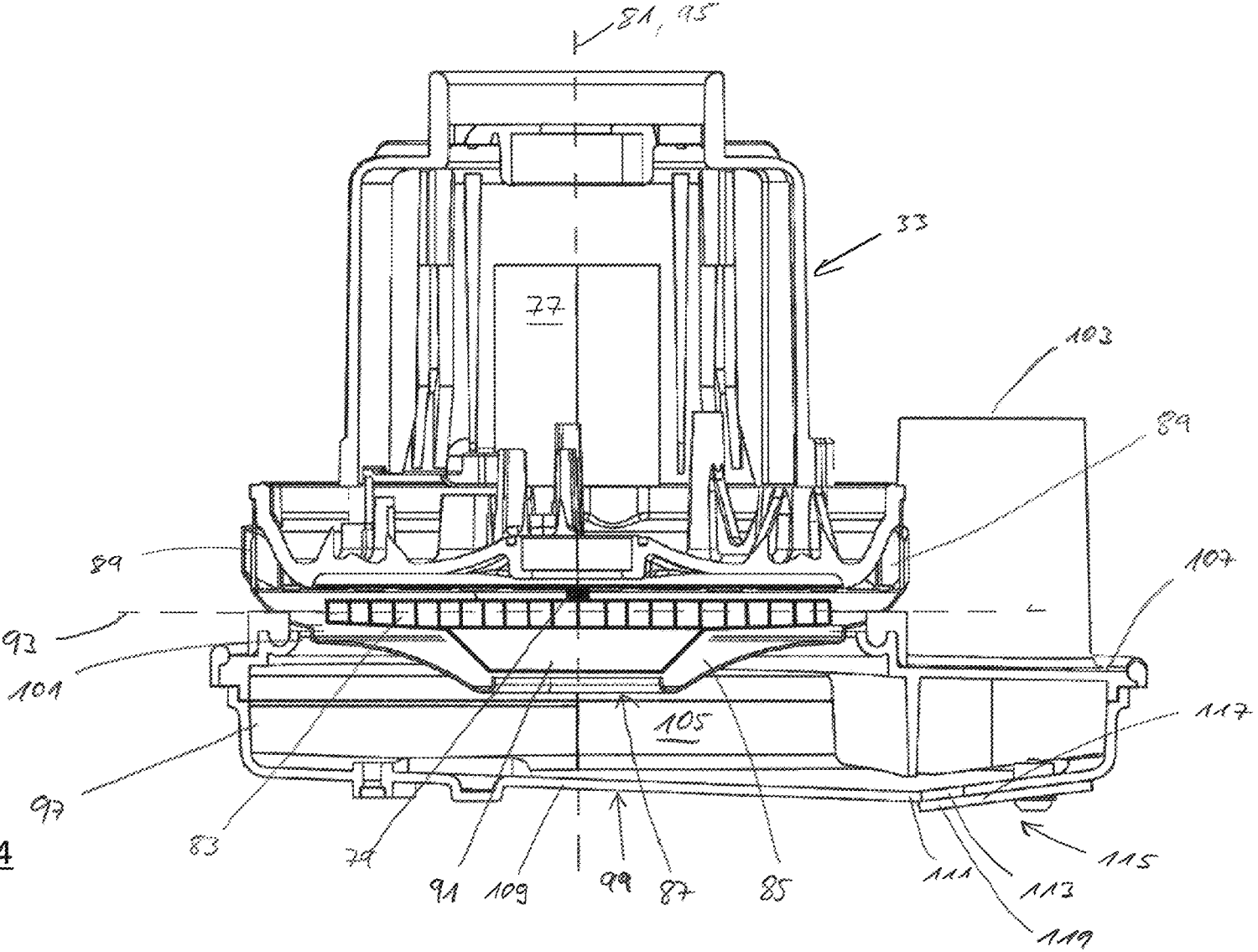
FIG. 4 is a cross-sectional view of part of the base of the floor cleaning machine from FIG. 1.

As can furthermore be seen from FIGS. 3 and 4, the suction turbine 33 has a turbine motor 77, which drives in rotation a motor shaft 79 which extends along a turbine wheel axis 81. Secured on the motor shaft 79 is a turbine wheel 83, and therefore the latter is driven in rotation by the turbine motor 77, and it then rotates about the turbine wheel axis 81.

In the exemplary embodiment illustrated here, the turbine wheel axis 81 coincides with the output axis 37 of the drive motor 31. However, it is also conceivable for the output axis 37 and the turbine wheel axis 81 to run offset with respect to one another. The suction turbine 33 is furthermore surrounded by a suction turbine housing 85, wherein the suction turbine housing 85 has an inlet opening 87 and a multiplicity of outlet openings 89. In the exemplary embodiment illustrated here, the turbine wheel 83 is designed as a radial fan wheel, and therefore, during rotation about the turbine wheel axis 81, it conveys air radially outwards from an inlet 91 situated on the turbine wheel axis 81, the inlet 91 being situated opposite the inlet opening 87. Thus, in the exemplary embodiment illustrated here, the turbine wheel 83 generates a flow which runs radially outward from the inlet 91 and is formed in the turbine wheel plane 93 defined by the turbine wheel 83. Therefore, in the embodiment illustrated here, the outlet openings 89 in the suction turbine housing 85 are formed at the level of the turbine wheel plane 93, thus ensuring that the suction air flow generated by the rotating turbine wheel 83 then emerges from the suction turbine housing 85 radially through the outlet openings 89, as can be seen schematically in FIG. 2.

As can furthermore be seen from FIGS. 3 and 4, in the embodiment illustrated here, the motor shaft 79 of the turbine motor 77 extends along a vertical axis 95 which runs perpendicularly to the engagement element plane 67 and thus also perpendicularly to the floor surface 3 to be cleaned. According to the disclosure, the inlet opening 87 in the suction turbine housing 85, when viewed along the vertical axis 95, is furthermore arranged in such a way that it is arranged closer to the engagement element plane 67 than the turbine wheel 83. Thus, if the floor cleaning machine 1 is arranged on a substantially horizontally extending floor surface 3 to be cleaned, the inlet opening 87 is below the turbine wheel 83.

As can furthermore be seen, in particular, from FIGS. 3 and 4, a separation container 97 is provided below the suction turbine 33 and thus closer to the engagement element plane 67 when viewed along the vertical axis 95, which container is detachably connected to the suction turbine housing 85 and the wall of which has a bottom wall section 99 which, when viewed along the vertical axis 95, is arranged closer to the engagement element plane 67 than the inlet opening 87 in the suction turbine housing 85. The bottom wall section 99 is furthermore situated opposite the inlet opening 87. In addition, the separation container 97 has a receiving opening 101, which is situated opposite the bottom wall section 99 and into which a section of the suction turbine housing 85 extends, wherein the edge of the receiving opening 101 surrounds the section of the suction turbine housing 85 in which the inlet opening 87 is provided. In this case, the edge of the receiving opening 101 rests sealingly against the suction turbine housing 85.

Moreover, the separation container 97 has an inlet 103, which is likewise connected to the interior 105 of the separation container 97, wherein, when viewed along the vertical axis 95, the inlet 103 is provided at a position in the interior 105 of the separation container 97 which is further away from the engagement element plane 67 than the bottom wall section 99. In particular, the inlet 103 is provided in a wall section 107 of the separation container 97 which, when viewed from the interior 105, faces away from the engagement element plane 67 and which extends substantially perpendicularly to the vertical axis 95. As a result, when the floor cleaning machine 1 is arranged on a floor surface 3 to be cleaned which extends substantially horizontally, the inlet 103 points vertically upwards. Finally, the inlet 103 is connected via the second line 25 to an upper section of the dirty water tank 19 on the operating bar 7. The interior 105 of the separation container 97 is thus connected overall to the inlet 103 as well as to the inlet opening 87.

Figure 5:
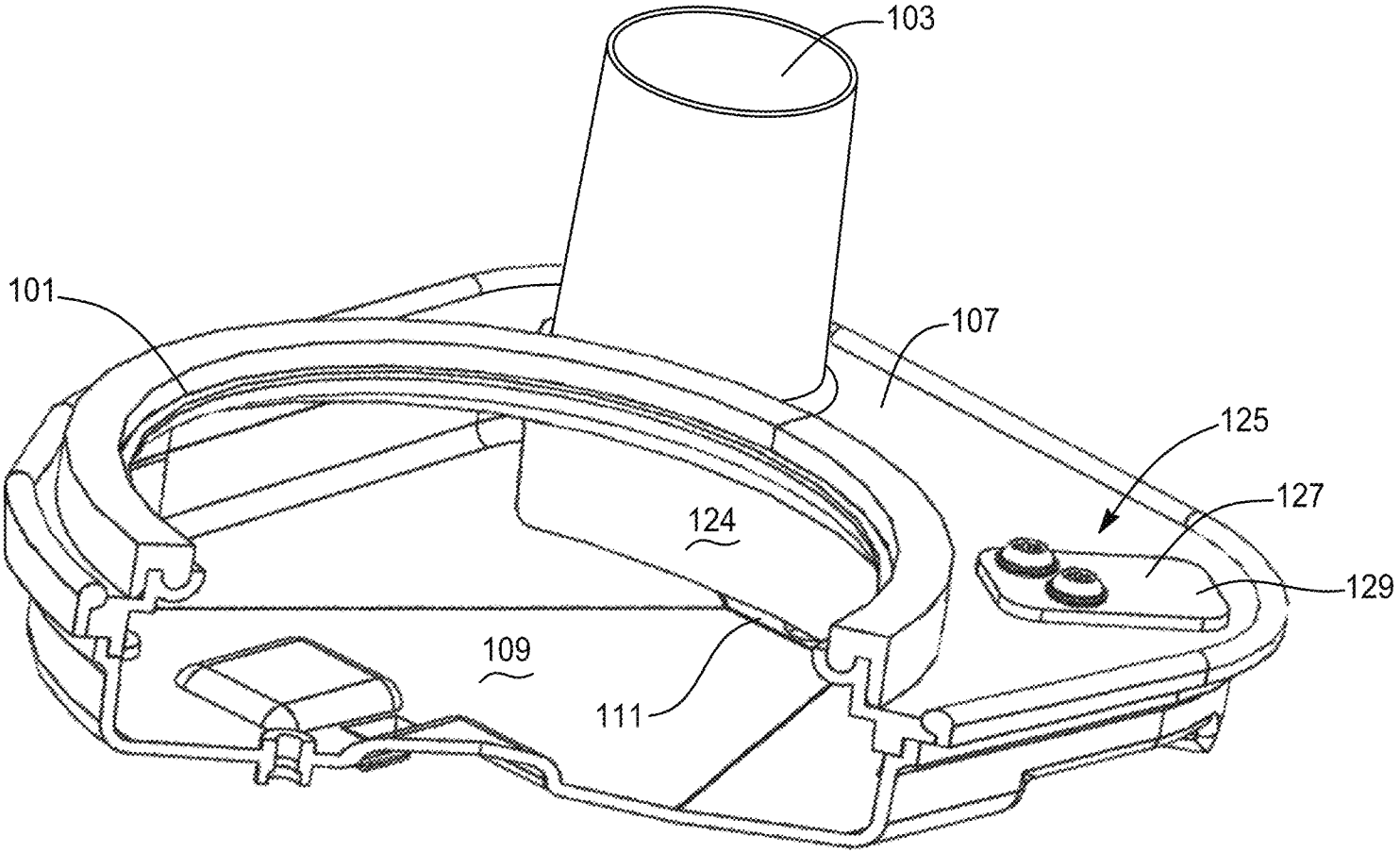
FIG. 5 is a perspective sectional view of the separation container for the suction turbine of the floor cleaning machine from FIG. 1.
Figure 6:
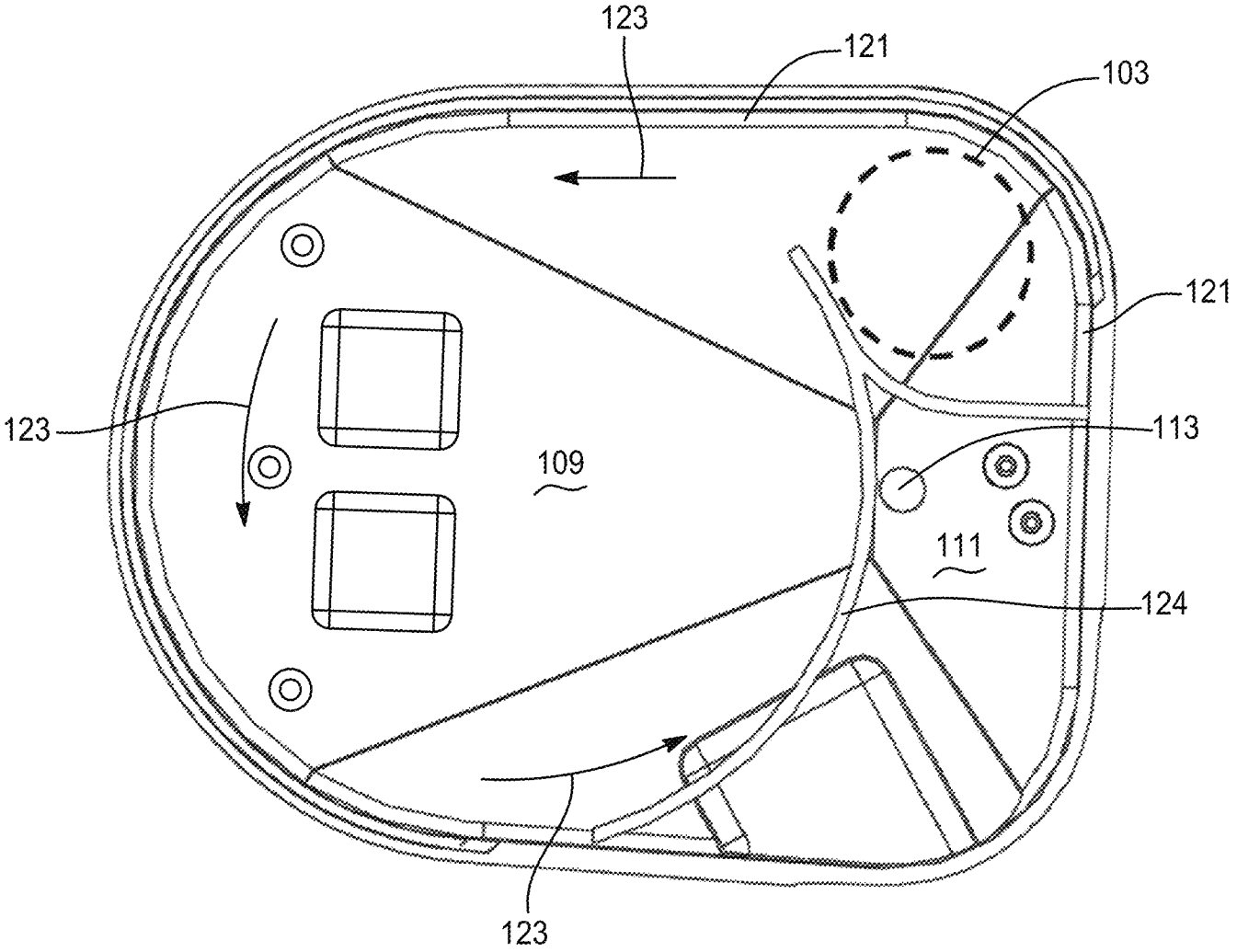
FIG. 6 is a horizontal section through the separation container for the suction turbine of the floor cleaning machine from FIG. 1.

Furthermore, it can be seen especially from FIG. 4, the perspective illustration of the separation container 97 from FIG. 5 and the sectional illustration in FIG. 6 that the bottom wall section 99 facing the interior 105 has an inlet opening section 109 which is situated opposite the inlet opening 87 in the suction turbine housing 85. In this case, the inlet opening section 109 is formed in such a way in the bottom wall section 99 of the separation container 97 that it is that section of the bottom wall section 99 which is situated opposite the inlet opening 87 when viewed in the direction of the vertical axis 95. Furthermore, the part of the inlet opening section 109 which is on the left when viewed in FIG. 4 lies closest to the inlet opening, when viewed in the direction of the vertical axis 95. Moreover, the bottom wall section 99 also has a drainage section 111, which, when viewed along the vertical axis 95, is that part of the bottom wall section 99 which is closest to the engagement element plane 67. When the floor cleaning machine 1 is arranged on a horizontally aligned floor surface 3 to be cleaned. Thus, the inlet opening section 109 is that section of the bottom wall section 99 which is highest, while the drainage section 111 is the section of the bottom wall section 99 which is lowest.

It can furthermore be seen, especially from FIGS. 4 and 6, that a drainage opening 113, which is in turn provided with a valve 115, is provided in the drainage section 111. In this case, the valve 115 is designed in such a way that it closes when the suction turbine 33 is in operation and a pressure which is below the ambient pressure, that is to say the pressure of the atmosphere which surrounds the floor cleaning machine 1, prevails in the interior 105 in the separation container 97. On the other hand, the valve 115 opens when the suction turbine is out of operation and the pressure in the interior 105 is equal to or greater than the ambient pressure.

In the exemplary embodiment described here, the valve 115 has a flexible tab 117, which is attached to the outside of the separation container 97, opposite the drainage opening 113, wherein the flexible tab 117 is prestressed in such a way that a section 119 thereof is spaced apart from the drainage opening 113 and exposes the latter when the pressure in the separation container 97 is greater than or equal to the ambient pressure. If, however, the pressure in the separation container 97 is below the ambient pressure, because the suction turbine 33 is in operation, the section 119 closes the drainage opening 113.

In the exemplary embodiment described here, the valve 115 is designed in such a way that it is actuated solely by the pressure in the interior 105 of the separation container 97. However, the present disclosure also encompasses other solutions in which a valve is used that is actuated in a manner dependent on whether the suction turbine 33 is in operation or not. This can be a solenoid valve, for example.

Furthermore, it can be seen, especially from FIGS. 5 and 6, that the inlet 103 is arranged in an edge region of the separation container 97, close to a peripheral wall 121 which extends substantially parallel to the vertical axis 95. As a result, a suction air flow generated by the suction turbine 33 initially enters the separation container 97 through the inlet 103 substantially perpendicularly to the bottom wall section 99 and is then deflected by 90°, wherein the suction air flow is then guided along the arrows 123 shown in FIG. 6 along the peripheral wall 121 and along a guide surface 124 provided in the interior 105 of the separation container 97. This has the effect that liquid droplets contained in the suction air flow are separated out at the peripheral wall 121 and the guide surface 124 and move from there in the direction of the drainage section 111 since this is the lowest section in the bottom wall section 99 and a gap is also provided between the guide surface 124 and the drainage section 111. The arrangement of the inlet 103 in a wall section 107 facing away from the engagement element plane 67 when viewed from the interior 105 and adjacent to the peripheral wall 121 thus has the effect that the separation container 97 acts in a manner similar to a cyclone separator.

Finally, it can be seen from FIG. 5 that an additional valve 125, which closes an opening provided in this wall section 107 and not illustrated in FIG. 5, is provided in the wall section 107 which, when viewed from the interior 105 of the separation container 97, faces away from the engagement element plane 67. In this case, valve 125 is of similar design to valve 115, i.e. it is closed when the suction turbine 33 is in operation and a pressure which is lower than the ambient pressure prevails in the interior 105 of the separation container 97, while it opens when the pressure in the interior 105 corresponds to the ambient pressure or is higher. Here, this valve 125 is likewise formed by a tab 127, which is prestressed in such a way that at least one section 129 thereof moves away from the wall section 107 and thus away from the opening provided therein when the pressure in the interior 105 corresponds to the ambient pressure or is higher, while the section 129 is applied to the wall section 107 when the pressure in the interior 105 is lower than the ambient pressure. Valve 125 is thus of substantially the same construction as valve 115. The opening closed by valve 125 serves as an air admission opening in order to ensure that when valve 115 opens, liquid present in the separation container 97 can also actually flow off.

During the operation of the above-described exemplary embodiment of a floor cleaning machine 1 according to the disclosure, a suction air flow is generated by the suction turbine 33 and the turbine wheel 83 driven by the turbine motor 77, this suction air flow flowing from the suction foot 21 through the first line 23 into the dirty water tank 19. As a result, cleaning liquid which has previously been applied to the floor surface 3 to be cleaned is sucked off by means of the suction air flow.

Figure 7:
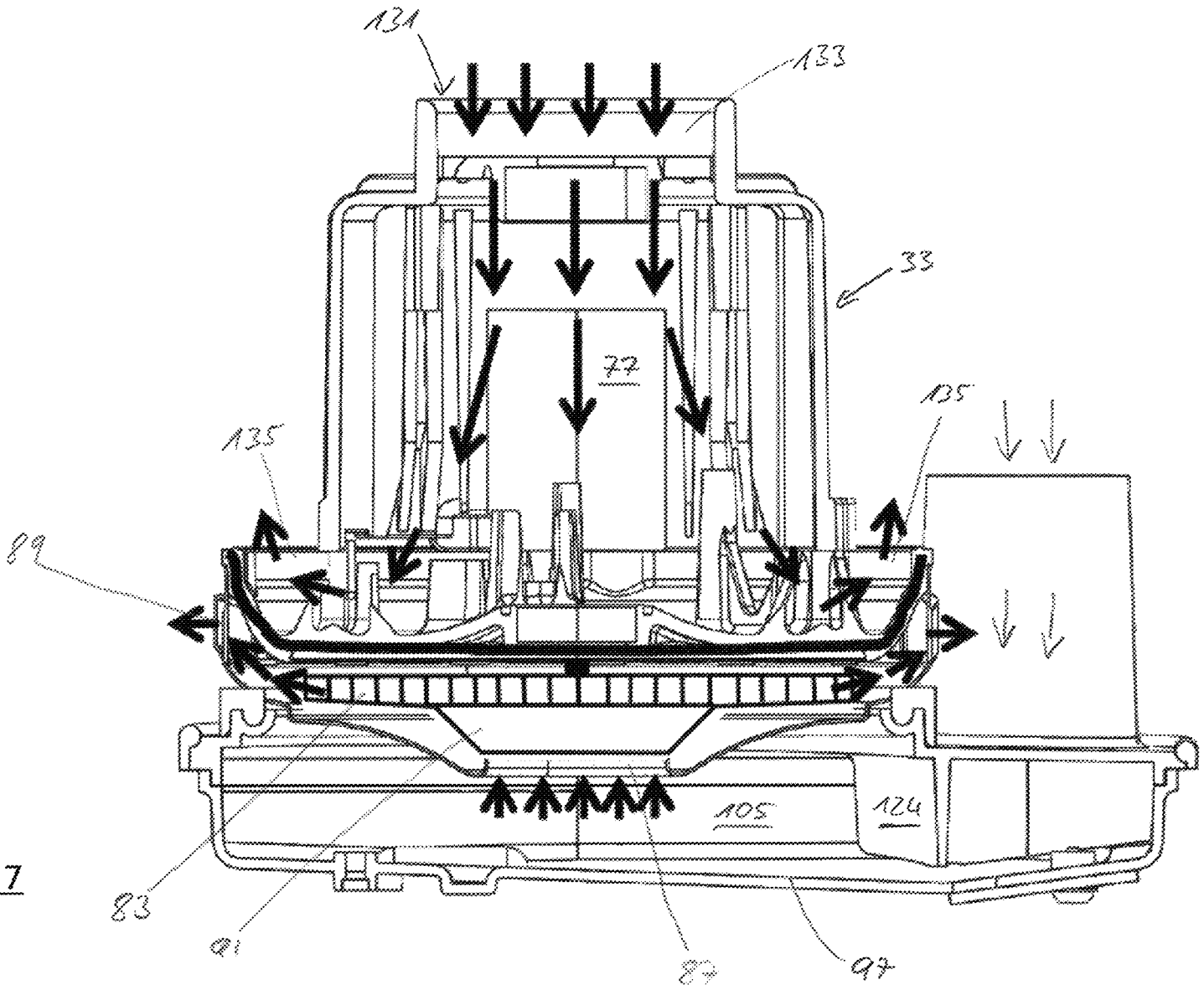
FIG. 7 is a cross-sectional view as in FIG. 4, wherein the air flow is depicted in the region of the suction turbine.

As can be seen especially from FIG. 7, the suction air flow flows onwards from the dirty water tank 19, through the second line 25, into the inlet 103 and into the interior 105 of the separation container 97. The suction air then flows onwards out of the interior 105 of the separation container 97 into the inlet opening 87, is conveyed radially outwards by the turbine wheel 83 and leaves the suction turbine housing 85 via the outlet openings 89. In this case, the flow inside the separation container 97 is guided in such a way that liquid contained in the suction air flow is separated off at the peripheral wall 121 and the guide surface.

As can furthermore be seen from FIG. 7, the suction turbine 33 has, at the end of the turbine motor 77 remote from the turbine wheel 83, on the motor shaft thereof, in the region of an intake opening 131, a fan wheel 133 via which cooling air is drawn through the turbine motor 77 during the operation of the suction turbine 33 and is ejected via outlet openings 135. In this way, the turbine motor 77 is simultaneously cooled. However, the air flows, i.e. on the one hand the suction air flow and on the other hand the cooling air flow through the motor, are separated from one another.

Since the separation container 97 is arranged closer to the engagement element plane 67 when viewed along the vertical axis 95, and the bottom wall section 99 is likewise situated closer to the engagement element plane 67, water contained in the suction air flow which is taken along as far as the separation container 97 is also separated out on the bottom wall section 99. Since the inlet opening section 109 is, in turn, the highest part of the bottom wall section 99, water settling there will then flow into the lower-lying drainage section 111 and initially collect there since, during the operation of the suction turbine 33, the pressure in the interior 105 of the separation container 97 will be below the ambient pressure, with the result that valve 115 is closed.

When the floor cleaning machine 1 and thus the suction turbine 33 or the turbine motor are switched off, the pressure in the interior 105 in the separation container 97 rises to the ambient pressure, with the result that valve 115 opens, and the water, which is present especially in the region of the drainage section 111, can flow off. Valve 125 then likewise opens and ensures that air can flow into the separation container 97, ensuring drainage via valve 115.

Thus, as a result of the separation container 97, which is arranged closer to the engagement element plane 67 when viewed in the direction of the vertical axis 95, it is achieved that water collects there and cannot get into the region of the turbine wheel 83 or of the turbine motor 77. On the contrary, the water is regularly discharged automatically via valve 115, ensuring that it is impossible for large amounts of water to accumulate in the region of the suction turbine 33.

Moreover, the fact that the suction turbine 33 is provided with a turbine wheel 83 which is situated "below" the turbine motor 77 ensures that the arrangement comprising the suction turbine 33 and the separation container 97 has only a small dimension in the vertical direction, that is to when viewed along the vertical axis 95. Overall, the base of the floor cleaning machine 1 thus has only a small height. Nevertheless, the suction turbine is arranged "upright", i.e. the turbine motor 77 is arranged above the turbine wheel 83 and the turbine wheel 83 rotates about a vertically extending axis.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

LIST OF REFERENCE SIGNS

| | |
|---|---|
| 1 | floor cleaning machine |
| 3 | floor surface |
| 5 | base |
| 7 | operating bar |
| 9 | joint |
| 11 | longitudinal axis |
| 13 | actuating end |
| 15 | vertical axis |
| 17 | cleaning liquid container |
| 19 | dirty water tank |

-continued

| | |
|---|---|
| 21 | suction foot |
| 23 | first line |
| 25 | second line |
| 27 | cleaning element arrangement |
| 29 | housing |
| 31 | drive motor |
| 33 | suction turbine |
| 35 | line |
| 37 | output axis |
| 39 | output shaft |
| 41 | first eccentric disc |
| 43 | second eccentric disc |
| 45 | first receiving element |
| 47 | first bearing |
| 49 | inner cleaning body |
| 51 | inner cleaning element |
| 53 | cleaning body plane |
| 55 | second receiving element |
| 57 | second bearing |
| 59 | outer cleaning body |
| 61 | outer cleaning element |
| 63 | engagement element |
| 65 | end section |
| 67 | engagement element plane |
| 69 | first elastic elements |
| 71 | second elastic elements |
| 73 | guide wheel |
| 75 | wheel axle |
| 77 | turbine motor |
| 79 | motor shaft |
| 81 | turbine wheel axis |
| 83 | turbine wheel |
| 85 | suction turbine housing |
| 87 | inlet opening |
| 89 | outlet opening |
| 91 | inlet |
| 93 | turbine wheel plane |
| 95 | vertical axis |
| 97 | separation container |
| 99 | bottom wall section |
| 101 | receiving opening |
| 103 | inlet |
| 105 | interior - separation container |
| 107 | wall section |
| 109 | inlet opening section |
| 111 | drainage section |
| 113 | drainage opening |
| 115 | valve |
| 117 | tab |
| 119 | section |
| 121 | peripheral wall |
| 123 | arrow |
| 124 | guide surface |
| 125 | valve |
| 127 | tab |
| 129 | section |
| 131 | suction opening |
| 133 | fan wheel |
| 135 | outlet opening |

What is claimed is:

1. A floor cleaning machine comprising:

a base, a cleaning element arrangement, held and driven on an underside of the base, the cleaning element arrangement being configured for engagement with a floor surface, wherein the cleaning element arrangement has at least one driven cleaning element, to which engagement elements for engagement with a floor surface to be cleaned are attached, wherein sections of the engagement elements which are provided for engagement with the floor surface extend in an engagement element plane, an operating bar, attached to the base, for guiding and actuating the floor cleaning machine, a suction foot, attached to the base or to the operating bar, the suction foot being configured for sucking up cleaning liquid from the floor surface, a dirty water tank, attached to the base or to the operating bar, for receiving cleaning liquid taken up by the suction foot, a suction turbine, which is attached to the base and has a suction turbine housing, which has an inlet opening and an outlet opening, wherein the suction turbine is configured to generate a suction air flow from the suction foot into the dirty water tank during operation, wherein the suction turbine is constructed in such a way that the suction air flow runs through the inlet opening towards the outlet opening, and a separation container that adjoins the suction turbine housing, the suction container having an interior, which communicates with the inlet opening, an inlet, which communicates with the interior, and a bottom wall section facing the interior, wherein, when viewed along a vertical axis running perpendicularly to the engagement element plane, the bottom wall section is arranged closer to the engagement element plane than the inlet opening, and wherein a drainage opening leads out of the bottom wall section into the environment, which opening is provided with a valve, which is configured in such a way that it is closed when the suction turbine is in operation and open when the suction turbine is out of operation.

2. The floor cleaning machine of claim 1, wherein the valve is configured in such a way that it closes when a pressure in the separation container is below the ambient pressure and opens when the pressure in the separation container is greater than or equal to the ambient pressure.

3. The floor cleaning machine of claim 2, wherein the valve has a flexible tab, which is attached to the outside of the separation container, opposite the drainage opening, and wherein the flexible tab is prestressed in such a way that a section thereof is spaced apart from the drainage opening and exposes the latter when the pressure in the separation container is greater than or equal to the ambient pressure, and that the section closes the drainage opening when the pressure in the separation container is below the ambient pressure.

4. The floor cleaning machine of claim 1, wherein the suction turbine has a turbine wheel, which is driven in rotation about a turbine wheel axis, wherein the turbine wheel axis coincides with the vertical axis, and wherein the inlet opening is closer to the engagement element plane than the turbine wheel when viewed in the direction of the vertical axis.

5. The floor cleaning machine of claim 4, wherein the suction turbine has a turbine motor with a rotationally driven motor shaft, wherein the motor shaft extends along the turbine wheel axis and is connected to the turbine wheel.

6. The floor cleaning machine of claim 4, wherein the turbine wheel is designed as a radial fan wheel which is configured in such a way that, during rotation, it generates an air flow from an inlet lying on the turbine wheel axis radially outwards, and wherein the suction turbine housing surrounds the turbine wheel, and the inlet opening is arranged on the turbine wheel axis and lies opposite the inlet.

7. The floor cleaning machine of claim 1, wherein the separation container has a receiving opening, which is situated opposite the bottom wall section and the edge of which rests sealingly against the suction turbine housing, wherein the inlet opening is arranged in that region of the suction turbine housing which is enclosed by the edge, and wherein the separation container is detachably connected to the suction turbine housing.

8. The floor cleaning machine of claim 1, wherein the bottom wall section has an inlet opening section, which is situated opposite the inlet opening, wherein the bottom wall section has a drainage section, from which the drainage opening starts, and wherein, when viewed along the vertical axis, the drainage section is closer to the engagement element plane than the inlet opening section.

9. The floor cleaning machine of claim 8, wherein the inlet opening section is a part of the bottom wall section which is closest to the inlet opening when viewed along the vertical axis.

10. The floor cleaning machine of claim 1, wherein, when viewed along the vertical axis, the inlet opens into the interior at a position which is further away from the engagement element plane than the bottom wall section.

11. The floor cleaning machine of claim 10, wherein the inlet is provided in a wall section of the separation container which, when viewed from the interior, faces away from the engagement element plane.

12. The floor cleaning machine of claim 1, wherein the suction foot is connected to the dirty water tank by a first, wherein the dirty water tank is connected to the inlet of the separation container by a second line, and wherein, when the suction turbine is in operation, the suction air flow runs from the suction foot, through the dirty water tank and through the separation container, to the inlet opening.

* * * * *